United States Patent [19]

LaSpesa

[11] Patent Number: 4,582,439

[45] Date of Patent: Apr. 15, 1986

[54] PRINTER RIBBON CARTRIDGE

[75] Inventor: Richard E. LaSpesa, Chicago, Ill.

[73] Assignee: AT&T Teletype Corporation, Skokie, Ill.

[21] Appl. No.: 636,776

[22] Filed: Aug. 1, 1984

[51] Int. Cl.[4] ..... B41J 32/02

[52] U.S. Cl. ..... 400/196.1; 400/208

[58] Field of Search ..... 400/194, 195, 196, 196.1, 400/207, 208, 208.1, 235, 235.1

[56] References Cited

U.S. PATENT DOCUMENTS

| | | | |
|---|---|---|---|
| 3,897,866 | 8/1975 | Mueller | 400/196.1 X |
| 3,977,512 | 8/1976 | Teagarden et al. | 400/196.1 X |
| 3,980,171 | 9/1976 | Frechette | 400/208 |
| 3,989,132 | 11/1976 | Carson, Jr. | 400/196.1 X |
| 4,046,247 | 9/1977 | LaSpesa et al. | 400/196 |
| 4,091,913 | 5/1978 | Ku et al. | 400/196 X |
| 4,210,403 | 7/1980 | Mazouet et al. | 400/196.1 |
| 4,212,550 | 7/1980 | Helinski | 400/196.1 |
| 4,247,209 | 1/1981 | Carlson et al. | 400/195 |
| 4,405,247 | 9/1983 | Hanna | 400/196.1 |
| 4,448,556 | 5/1984 | Trezise et al. | 400/196 X |
| 4,472,074 | 9/1984 | Gabler | 400/207 X |

*Primary Examiner*—Charles A. Pearson
*Attorney, Agent, or Firm*—A. A. Tirva

[57] ABSTRACT

A cartridge using an endless printer ribbon includes a re-inker and a drive assembly which pulls the ribbon through the re-inker and advances it while folding it in fan fold fashion into a storage compartment. The fan folds are compressed before they exit from the storage compartment into an expansion area where the fan folds unfold. From the expansion chamber the ribbon passes through a straightening compartment to ensure that all the folds in the ribbon have been eliminated before the ribbon leaves the cartridge.

1 Claim, 5 Drawing Figures

PRINTER RIBBON CARTRIDGE

DESCRIPTION

1. Technical Field

This invention relates to impact printers and more particularly to impact printers wherein a ribbon moves between a ribbon storage area and a printing area to continuously supply fresh ribbon to a position between character printing elements and a record medium.

2. Background Art

In printers of this type, printer ribbon storage has typically been provided by cartridges. The cartridges are removable so as to permit the ribbon supply to be replenished by merely replacing a ribbon cartridge. In various printers, including teleprinters such as those manufactured by Teletype Corporation, the platen which supports the recording medium remains stationary and the print head containing character printing elements moves along the platen to the various printing positions. In this type of printer, the cartridge is mounted for movement with the print head so as to continuously supply fresh ribbon to the printing position as the print head moves along the platen. Typically, the print head and the cartridge are supported on a carriage which is the vehicle for moving both the print head and the cartridge parallel to the platen.

When a printer has to operate at a high speed, its carriage must be capable of high acceleration and deceleration rates, and consequently the total mass of the carriage, print head and ribbon cartridge has to be kept as low as possible in order to reduce the demand on the carriage drive motor and its power supply. To reduce the overall weight, the weight of the cartridge also has to be reduced and this has been accomplished by manufacturing it from lightweight plastics, scaling down its physical size, as well as, the length of the ribbon stored in the cartridge.

To meet the above-mentioned requirements, a cartridge design has evolved, wherein the ribbon, after leaving the printing position, is "stuffed" into a storage compartment in the cartridge by first folding the ribbon in fan fold fashion and then compressing the folds one against the other. To introduce a fresh supply of ribbon into the printing position, the ribbon is drawn from the storage compartment. When the ribbon leaves the storage compartment, it has to be "straightened", i.e. it has to be unfolded so that a fold does not snag within the cartridge or that one or more folds do not enter the printing area and snag a printing element. Commercially available cartridges utilize several different ribbon straightening arrangements to prevent ribbon snags. None of the arrangements, however, are 100% effective so that from time to time a ribbon snag does occur, and information being printed may be lost.

DISCLOSURE OF THE INVENTION

In accordance with the present invention, I provide a printer ribbon cartridge which includes an endless band of ribbon, a re-inker mechanism, a ribbon storage compartment, a ribbon drive mechanism which pulls the ribbon through the re-inker and advances it into the storage compartment while forming the ribbon into folds. The folds are then compressed before entering an expansion chamber and unfolding by utilizing energy gained through compression. The ribbon then passes through a straightening compartment which ensures that all folds are eliminated before the ribbon leaves the cartridge.

THE DRAWINGS

DETAILED DESCRIPTION

Figure 1:
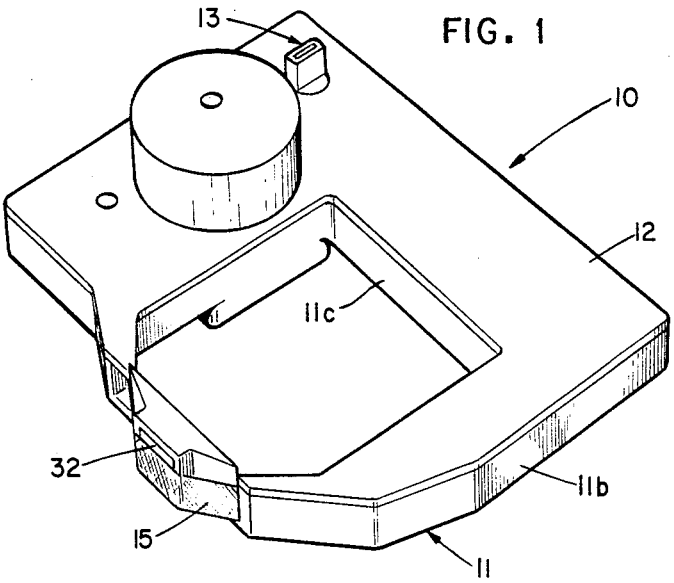
FIG. 1 shows a perspective view of a ribbon cartridge.
Figure 2:
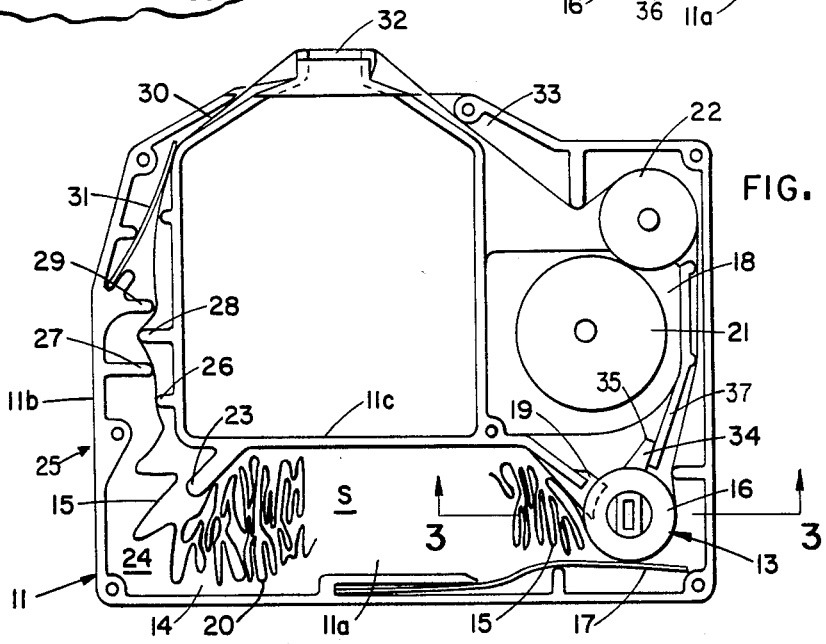
FIG. 2 shows a top plan view of the cartridge, shown in FIG. 1., with the cover removed to facilitate an explanation of the cartridge designed in accordance with the principles of the present invention.

FIGS. 1 and 2 show a cartridge assembly 10 embodying the principles of the present invention. The assembly 10 includes a lower half housing 11 having a base 11*a*. The outer periphery of the assembly 10 has an upright wall 11*b* while the inner periphery has an upright wall 11*c*. The lower half housing 11 mates with a lid 12 having a peripheral configuration substantially identical to the configuration of the lower half housing 11.

The inner and outer walls 11*c* and 11*b* cooperate with the base portion 11*a* and the lid 12 to define a hollow interior storage compartment S of a substantially rectangular configuration and extending between a drive assembly 13 and an expansion chamber 24.

The inner wall 11*c* defines a space which is occupied by a print head assembly (not shown) which along with the cartridge assembly 10 is mounted upon a carriage assembly (not shown) for moving the print head as well as the cartridge assembly 10 relative to a record medium (not shown).

Figure 3:
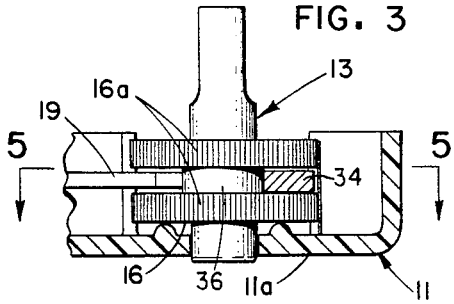
FIG. 3 is a sectional view of the cartridge taken along line 3—3 of FIG. 2.

The height of the hollow interior storage compartment S is sufficient to store an inked ribbon 15 which is formed into a continuous, closed loop. The ribbon 15 is stored within the assembly 10 in an upright fashion so that the plane of the ribbon 15 is substantially perpendicular to the base 11*a*. Ribbon 15 enters the storage compartment S through the drive assembly 13 comprises of a split roller 16, shown in greater detail in FIG. 3, having two halves joined by a cylindrical hub 36, each half having a knurled cylindrical surface 16*a*. The roller 16 cooperates with a spring 17 which presses the ribbon 15 against the knurled surfaces 16*a* whereby sufficient force is exerted on the ribbon 15 to pull it through a re-inking mechanism 18 and to push it into the storage area S.

The re-inking mechanism 18 is comprised of an ink roller 21 and a transfer roller 22 which is in continuous contact with the ink roller 21 and the ribbon 15. Re-inking mechanism of the type shown in FIG. 1 is well-known in the art and its construction and operation are discussed in detail in U.S. Pat. No. 4,046,247.

As the freshly inked ribbon 15 is pushed by drive assembly 13 into the storage compartment S, it tends to stick to the knurled surfaces 16*a* of the roller 16. To prevent the ribbon 15 from winding around the roller 16 and eventually jamming the drive assembly 13, the ribbon 15 is stripped from the knurled surfaces 16*a* by a stripper spring 19. The stripper spring 19 has one end anchored in the storage compartment S, while its free end is positioned between the knurled surfaces 16*a*. As shown in FIG. 2, the stripping action by spring 19 causes the ribbon 15 to start forming into folds 20, the height of the folds 20 being determined substantially by the diameter of the roller 16 and the position of the stripper spring 19. The folds 20, formed as the ribbon 15 is stripped off the roller 16, move into the storage area S pushing against folds 20 which were formed previously and forcing them towards a fold compression area 14.

As the folds 20 move through the storage compartment S, they come into the compression area 14 which is comprised of a projection 23 extending from the inner wall 11*c* into the storage compartment S. The projection 23 forms an angle of substantially 45 degrees with the inner wall 11*c* and guides the folds 20 towards the outer wall 11*b* deforming the folds 20 by forcing them to fold upon themselves.

To present a fresh portion of ribbon 15 in a printing area 32, the ribbon 15 is pulled from the storage compartment S by pulling several compressed folds 20 at a time from the compression area 14 into the expansion chamber 24. The compressed fold 20, upon entering the expansion chamber 24 release the stored energy gained by deformation in the compression area 14 by virtually exploding into the expansion chamber 24 causing the folds 20 to unfold.

As the ribbon 15 moves from the expansion chamber 24, it enters a ribbon straightening compartment 25 comprised of projections 26 and 28 extending from the wall 11*c* and projections 27 and 29 extending from the wall 11*b*. The projections are substantially equidistant from each other and their function is to ensure that any folds 20 remaining as the ribbon 15 leaves the expansion chamber 24 are eliminated before the ribbon 15 enters the printing area.

As can be seen from FIG. 2, projections 27 and 29 extend from the outer wall 11*b* towards the inner wall 11*c* and the projections 26 and 28 extend from the inner wall 11*c* towards the outer wall 11*b* such that the tips of projections 26, 27 and 29 are tangent to an imaginary straight line (not shown). Projection 28 extends approximately twice the distance towards the outer wall 11*b* as compared to projection 26 forcing the portion of the ribbon 15 passing through the compartment 25 to maintain continuous contact with projections 26, 27 and 29. The distances between the projections 26 through 29 are made less than the maximum possible height of the folds 20 thus pulling the ribbon 15 through the chamber 25 eliminates any folds 20 remaining after the ribbon 15 leaves the expansion chamber 24.

The ribbon 15 as it leaves compartment 25 enters a ribbon outlet area 30. A spring 31 biases the ribbon 15 against the inner wall 11*c* furnishing a substantially constant tension against which the drive mechanism 13 operates. The ribbon 15, after leaving outlet area 30, passes across the printing area 32 and enters back into the cartridge 10 through an inlet area 33. From the inlet area 33, the ribbon advances through the re-inking mechanism 18 and then proceeds back to the storge compartment S.

Figure 4:
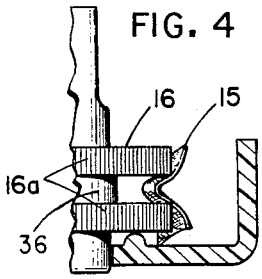
FIG. 4 shows a partial sectional view of the cartridge shown in FIG. 3.
Figure 5:
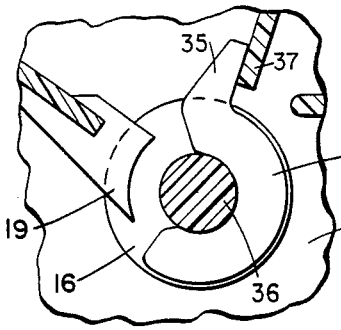
FIG. 5 shows a sectional view of the cartridge taken along line 5—5 of FIG. 3.

After prolonged use, the middle section of ribbon 15, because it is subjected repeatedly to impacts by character printing elements, is weakened relative to the outer sections of the ribbon. Consequently, as the ribbon 15 is pulled by the split roller 16, the middle section of the ribbon may collapse as illustrated in FIG. 4. The collapsed middle section enters the space between the two portions of the split roller 16 and may cause a ribbon jam. To overcome this, a substantially C-shaped member 34 with a tab 35 extending from one end, having an outer diameter substantially equal to the diameters of knurled surfaces 16*a* and an inner diameter to slidably accommodate a portion of the cylindrical hub 36, is positioned between the two halves of the split roller 16, as shown in FIG. 5, so that the middle portion of the ribbon 15 in contact with the knurled surfaces 16*a* is supported up to the time the ribbon 15 leaves the roller 16 after contacting the stripper 19.

What is claimed is:

1. A ribbon cartridge for use in a printer having a print head moveable relative to a record medium, the cartridge comprising:

an endless loop of ribbon;

a U-shaped housing having an open top enclosure, the enclosure having a bottom and inner and outer walls, a lid for covering the enclosure, and an inlet and an outlet end located opposite each other;

means for re-inking the ribbon located at the inlet end of the housing;

a ribbon storage compartment having a substantially rectangular shape located between the inlet and outlet ends;

a ribbon drive means located between the storage compartment and the re-inking means and adapted to pull the ribbon through the re-inking means and advance it into the storage compartment, the ribbon drive means including a rotatably mounted split roller having two halves joined by a cylindrical hub, each half having a knurled peripheral surface and a flexible member arranged to keep the ribbon in contact with the knurled surfaces;

means for supporting the section of the ribbon spanning the space between the two knurled surfaces while the ribbon is in contact with the knurled surfaces of the split roller, said means including a substantially C-shaped member having an outer diameter substantially equal to the diameter of the knurled surfaces and an inner diameter adapted to slidably accommodate a portion of the cylindrical hub, said member having a tab extending from one of its ends and being adapted to contact a portion of the cartridge housing;

means for rotating the split roller;

means for forming the ribbon into fan folds as the ribbon advances into the storage compartment;

means for compressing the fan folds;

an expansion chamber for allowing the compressed folds to expand and unfold; and means for straightening the ribbon comprising four projections: a first and a third projection extending from the inner wall of the housing towards the outer wall of the housing and a second and a fourth projection extending from the outer wall of the housing towards the inner wall of the housing, the projections being substantially equidistant from each other and having the tips of the first, second and fourth projections positioned along an imaginary straight line, the third projections extending toward the outer wall substantially twice as far as the first projection whereby the ribbon passing past the projections is kept in contact with the tips of the first, second and fourth projections, thereby eliminating any folds which may remain in the ribbon after it leaves the expansion chamber.

* * * * *